US008006600B2

(12) United States Patent
Fujiwara et al.

(10) Patent No.: US 8,006,600 B2
(45) Date of Patent: Aug. 30, 2011

(54) MULTIPLE BLASTING TREATING METHOD

(75) Inventors: Shuzo Fujiwara, Tsukuba (JP); Takehiro Matsunaga, Tsukuba (JP); Kiyoshi Asahina, Kobe (JP); Kenji Koide, Kobe (JP); Takashi Gotou, Kobe (JP); Hideaki Shimoda, Kobe (JP)

(73) Assignees: Kabushiki Kaisha Kobe Seiko Sho, Kobe-shi (JP); National Institute of Advanced Industrial Science and Technology, Tokyo (JP)

( * ) Notice: Subject to any disclaimer, the term of this patent is extended or adjusted under 35 U.S.C. 154(b) by 994 days.

(21) Appl. No.: 11/911,038

(22) PCT Filed: Mar. 6, 2006

(86) PCT No.: PCT/JP2006/304254

§ 371 (c)(1),
(2), (4) Date: Oct. 9, 2007

(87) PCT Pub. No.: WO2006/112182

PCT Pub. Date: Oct. 26, 2006

(65) Prior Publication Data

US 2009/0081928 A1 Mar. 26, 2009

(30) Foreign Application Priority Data

Apr. 8, 2005 (JP) ..... 2005-112421

(51) Int. Cl.
*F42B 33/00* (2006.01)

(52) U.S. Cl. ..... 86/50; 110/237

(58) Field of Classification Search ..... 86/50
See application file for complete search history.

(56) References Cited

U.S. PATENT DOCUMENTS

| | | | | |
|---|---|---|---|---|
| 2,165,935 | A * | 7/1939 | Menzel | 422/307 |
| 2,940,300 | A * | 6/1960 | Loving, Jr. | 73/35.17 |
| 3,075,461 | A | 1/1963 | Ehlmann | |
| 3,165,916 | A * | 1/1965 | Loving, Jr. | 73/35.17 |
| 3,554,299 | A * | 1/1971 | Sullivan | 175/4.55 |

(Continued)

FOREIGN PATENT DOCUMENTS

JP 7 208899 8/1995

(Continued)

OTHER PUBLICATIONS

US Army Corps of Engineers Engineering and Support Center, Huntsville, "Procedures for Demolition of Multiple Rounds (Consolidated Shots) on Ordnance and Explosives (OE) Sites", Aug. 1998 (Terminology Update Mar. 2000), Sections 2.0 and 4.0.*

*Primary Examiner* — Michael Carone
*Assistant Examiner* — Richard L Norman, Jr.
(74) *Attorney, Agent, or Firm* — Oblon, Spivak, McClelland, Maier & Neustadt, L.L.P.

(57) ABSTRACT

A method of blasting hazardous substance or explosive in a pressure vessel is provided to improve efficiency while suppressing enlargement of the pressure vessel. To achieve it, the method includes an installing step of installing two or more articles to be treated at a certain spacing in the pressure vessel, an initial blasting step of blasting one of the articles to be treated, and a following blasting step of blasting the article to be treated next to the previously blasted article to be treated after a particular time from the instant of the previous blast. Each of the articles is blasted sequentially through the initial and following blasting steps.

4 Claims, 4 Drawing Sheets

U.S. PATENT DOCUMENTS

| | | | | |
|---|---|---|---|---|
| 3,793,101 | A | 2/1974 | Mullarkey | |
| 3,804,017 | A * | 4/1974 | Venable et al. | 102/301 |
| 3,820,435 | A * | 6/1974 | Loving, Jr. | 89/1.1 |
| 3,877,376 | A * | 4/1975 | Kupelian | 102/492 |
| 4,055,247 | A * | 10/1977 | Benedick et al. | 206/3 |
| 4,178,854 | A * | 12/1979 | Schillreff | 102/377 |
| 4,725,991 | A * | 2/1988 | Crenwelge et al. | 367/23 |
| 5,274,356 | A * | 12/1993 | Taricco | 340/515 |
| 5,582,119 | A | 12/1996 | Barkdoll | |
| 5,613,453 | A | 3/1997 | Donovan | |
| 5,884,569 | A | 3/1999 | Donovan | |
| RE36,912 | E | 10/2000 | Donovan | |
| 6,173,662 | B1 | 1/2001 | Donovan | |
| 6,260,464 | B1 * | 7/2001 | Gorrell et al. | 86/50 |
| 6,354,181 | B1 | 3/2002 | Donovan | |
| 6,422,147 | B1 * | 7/2002 | Shann | 102/312 |
| 6,647,851 | B2 | 11/2003 | Donovan | |
| 7,073,424 | B2 * | 7/2006 | Ferrari et al. | 86/50 |
| 2003/0050524 | A1 | 3/2003 | Northcutt | |
| 2003/0209133 | A1 * | 11/2003 | Greenfield et al. | 86/50 |
| 2005/0022656 | A1 * | 2/2005 | Donovan et al. | 86/50 |
| 2005/0150369 | A1 * | 7/2005 | Lacombe et al. | 86/50 |
| 2005/0192472 | A1 | 9/2005 | Quimby et al. | |

FOREIGN PATENT DOCUMENTS

| | | |
|---|---|---|
| JP | 2004 50012 | 2/2004 |
| JP | 2004 324997 | 11/2004 |

* cited by examiner

MULTIPLE BLASTING TREATING METHOD

TECHNICAL FIELD

The present invention relates to a blasting method of blasting an article to be treated such as a hazardous substance or an explosive in a pressure vessel.

BACKGROUND ART

There is known a military munitions including a steel shell filled with burster and chemical agent hazardous to the body, used for chemical weapons and others (e.g., projectile, mortar, bomb, land mine, and naval mine). Examples of the chemical agents include mustard and lewisite, which are hazardous to the body.

As a method for processing (e.g., detoxifying) such chemical weapons and hazardous substances such as organic halogen compounds, blasting disposal has been known. The blasting disposal of military munitions, which requires no disassembling operation, has advantages of adaptability to a disposal not only of favorably preserved munitions but also of munitions hard to disassemble because of its deterioration and deformation, and of decomposing capability of most of the chemical agents therein under the ultrahigh temperature and ultrahigh pressure generated by explosion. Such a method is disclosed in Patent Document 1, for example.

The blasting disposal is frequently performed within a tightly sealed vessel to prevent the chemical agents from leaking to outside and to reduce adverse effects on environment such as noise and vibration due to blast. Furthermore, it can ensure the prevention of the outward leakage of the chemical agents to perform the blasting disposal within the vacuumed pressure vessel and keep the negative pressure in the vessel even after the blast.

Patent Document 1: Japanese Unexamined Patent Publication No. 7-208899

DISCLOSURE OF THE INVENTION

Problems to be Solved by the Invention

When an explosive is blasted by the method described in the Patent Document 1, the pressure vessel is exposed to intense explosion shock wave. Accordingly, a heavy mechanical load is applied to the pressure vessel.

On the other hand, recently, the Japanese Government ratified the Chemical Weapons Convention and has an obligation under the convention to destroy chemical weapons left in China by the former Japanese Army. According to the "Outline of the Project for the Destruction of Chemical Weapons abandoned by the old Japanese army" issued in October 2002 by the Abandoned Chemical Weapons Office, Cabinet Office, there are estimated, approximately 700,000 chemical weapons still abandoned in all areas of China. In designing the processing facility, the report says that a facility should have a processing capacity of 120 munitions per hour, assuming that 700,000 munitions are processed in three years. Accordingly, there is a strong need for efficient low-cost processing of the many abandoned chemical weapons, in the processing of the explosives described above.

To improve the efficiency, two or more munitions might be simultaneously blasted in one operation. However, such simultaneous blast of two or more munitions generates more intense explosion shock wave. Intensification of the explosion shock wave intensifies the impact force applied to the pressure vessel to increase a mechanical load applied to the pressure vessel. Specifically, the larger the impact force, the faster the advance of metal fatigue at various parts in the pressure vessel due to repeated action of the impact force to the pressure vessel during periods of use thereof, which shortens the life of the pressure vessel. In addition, an extremely great impact force may cause plastic deformation and brittle fracture in the pressure vessel to put the pressure vessel out of use.

Such troubles may be prevented by design for a high-strength pressure vessel capable of withstanding a great impact force described above, but the design result in significant enlargement of the pressure vessel and increase in a facility cost.

The present invention, to solve the problems, provides a blasting method of blasting an article to be treated such as hazardous substance or explosive in a pressure vessel. The method comprises an installing step of installing two or more articles to be treated at a certain spacing in the pressure vessel, an initial blasting step of blasting one of the articles to be treated, and a following blasting step of blasting the article to be treated next to the previously blasted article to be treated after a particular time from the instant of the previous blast. Each of the articles is blasted sequentially through the initial and following blasting steps.

The method enables blasting two or more articles to be treated in one operation to improve efficiency significantly. Moreover, It inhibits increase in load on the pressure vessel.

BEST MODE EMBODIMENT FOR CARRYING OUT THE INVENTION

An embodiment of the blasting method according to the present invention will be described below with reference to drawings.

Figure 2:
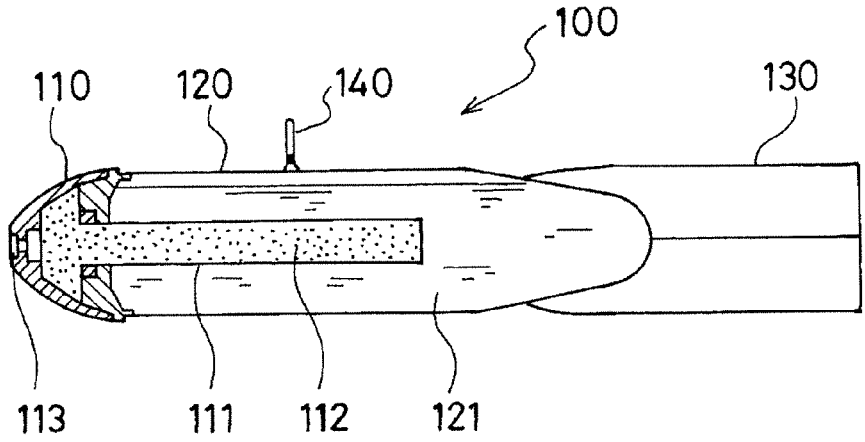
FIG. 2 is a schematic cross-sectional view illustrating a construction of a chemical bomb to be blasted in the method described above.

First, a chemical bomb (chemical weapon), an example of an explosive blasted in the blasting method in the present embodiment, will be described with reference to FIG. 2. FIG. 2 is a schematic sectional view showing a configuration of the chemical bomb described above.

The chemical bomb (explosive) 100 shown in FIG. 2 has a nose 110, a burster tube 111, a bomb shell 120, and an attitude-controlling fins 130.

The burster tube 111, extending backward from the nose 110, contains a burster (explosive) 112. The nose 110 is provided therein with a fuse 113 for bursting the burster 112 in the burster tube 111.

The bomb shell 120 is connected to the nose 110, while containing the burster tube 111 therein. The bomb shell 120 is filled with a liquid chemical agent (hazardous substance) 121. The attitude-controlling fins 130, which is placed at an end position opposite to the nose 110 in the axial direction of the bomb shell 120, controls an attitude of the dropped chemical bomb 100.

The top of the bomb shell 120 is provided with a hoist ring 140 to hoist the chemical bomb 100 and load it on an airplane.

An object to be treated in the present embodiment is all or part of the chemical bomb 100 containing at least an explosive 112 and a chemical agent 121 as described above.

The present invention is not limited to the chemical bomb 100 filled with the chemical agent 121 as described above, and is also applicable to blasting only a burster unit in the chemical bomb in the pressure vessel after disassembly of the chemical bomb.

Examples of the explosives blasted in the present invention include military explosives such as TNT, picric acid, and RDX, blister agents such as mustard and lewisite, vomiting agents such as DC and DA, and chemical agents such as phosgene, sarin, and hydrocyanic acid.

In addition, the blasting facility in the present embodiment may also be used in blasting not only the above-illustrated chemical bomb 100 but also, for example, hazardous substance such as organic halogen contained in respective containers.

Figure 1:
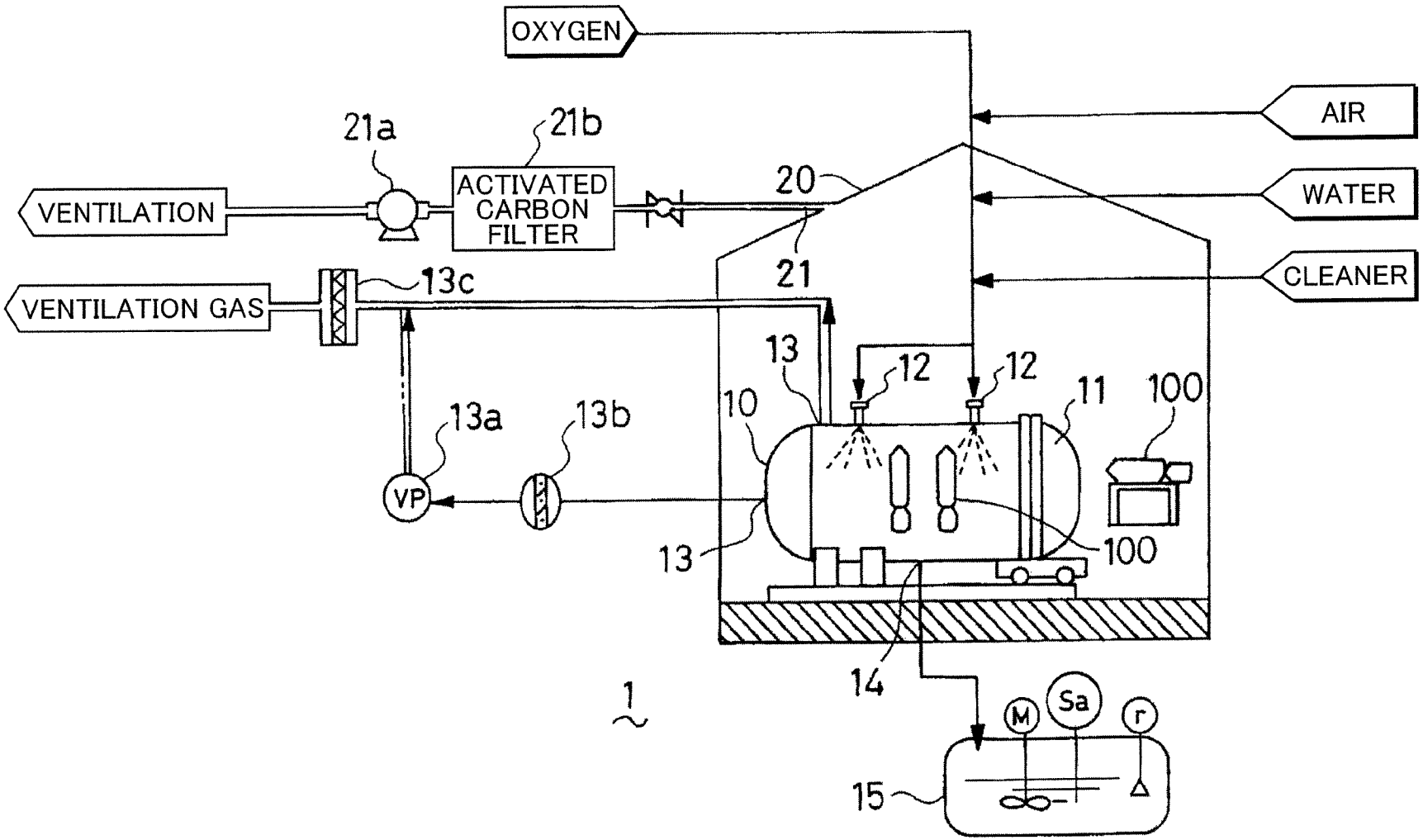
FIG. 1 is a schematic view illustrating an entire construction of a blasting facility in which a method in an embodiment of the present invention is practiced.

Hereinafter, there will be described an out door facility as an example of the facility for blasting the explosive such as the chemical bomb 100 described above, with reference to FIG. 1. FIG. 1 is a schematic view illustrating a configuration of the blasting facility.

The blasting facility 1 shown in FIG. 1 includes a pressure vessel 10 and a tent 20 for accommodating the pressure vessel 10 inside, as its main components.

The pressure vessel 10 has an explosion-proof construction of steel or the like, made rigid enough to withstand the blasting pressure during blasting the explosive device such as chemical bomb 100 inside. The pressure vessel 10 is a hollow vessel extending in one direction and placed so that its longitudinal direction is horizontal.

The pressure vessel 10 has a main body and is provided with a pressure-proof lid 11 removable from the main body at one of both ends of the pressure vessel 10 in its longitudinal direction. The pressure-proof lid 11 is removed from the main body to allow an explosive transported such as chemical bomb 100 to be introduced into the pressure vessel 10. A chemical bomb 100 or the like is introduced into the pressure vessel 10 thereby, and fixed in the pressure vessel 10 by a fixing means not shown in the Figure. Thereafter, the pressure-proof lid 11 is attached to the main body to make the pressure vessel 10 closed. In this state, the explosive is blasted.

In the present embodiment, two chemical bombs 100 are blasted in one blasting operation.

The top of the pressure vessel 10 is formed with a plurality of injection ports 12. These injection ports 12 are used for injection of oxygen into the pressure vessel 10 before blasting and for injection of air, water, cleaner and others into the pressure vessel 10 for decontamination operation after blasting.

In addition, there are formed two exhaust vents 13 on the top of the pressure vessel 10 and on the side wall opposite to the pressure-proof lid 11. The exhaust vents 13 are used to make the vessel under a reduced-pressure or vacuum state by ventilating air from inside the pressure vessel 10 through a filter 13*b* by using a vacuum pump 13*a* before blasting and to ventilate the vessel exhaust air such as vessel vent from inside the pressure vessel 10 through a filter 13*c* after blasting.

In addition, the bottom of the pressure vessel 10 is formed with a drainage port 14, through which waste water generated by decontamination operation is discharged into a processing tank 15.

There is placed an ignition device not shown in the Figure outside the pressure vessel 10 to ignite the explosive device such as chemical bomb 100 fixed in the pressure vessel 10. The ignition device enables blasting by remote control.

A strong wall is preferably formed surrounding the pressure vessel 10 so that the tent 20 will be protected in case that the explosive such as the chemical bomb 100 happens to break the pressure vessel 10 down.

The tent 20 has a door not shown in the Figure, and the door is opened to allow the pressure vessel 10 and an explosive such as chemical bomb 100 to be transported into the tent 20. The tent 20 is provided with an exhaust vent 21, which is used for ventilation of the exhaust air from the tent 20 through a filter 21*b*, for example containing activated carbon, by using a blower 21*a*.

Thus, in the present embodiment, blasting disposal of the chemical bomb 100 is performed in the blasting facility 1 including at least the pressure vessel 10 above.

Figure 3:
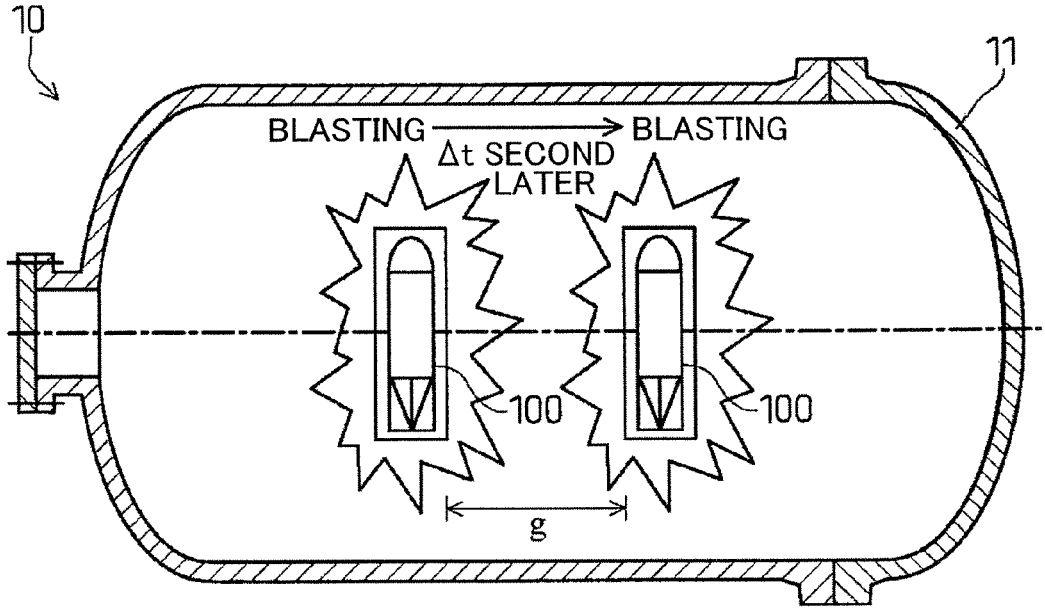
FIG. 3 is a cross-sectional view illustrating an example of a location of two or more chemical bombs in a pressure vessel for spacing the bombs to blast them sequentially in one operation.

Hereinafter, there will be described an installing step of installing the chemical bombs 100 in the pressure vessel 10 and a blasting step thereafter with reference to FIG. 3. FIG. 3 is a internal cross-sectional view of the internal pressure vessel 10.

In the installing step, as shown in the Figure, two chemical bombs 100 are installed in the pressure vessel 10, and the pressure-proof lid 11 is thereafter attached to the main body of the pressure vessel 10 to make the pressure vessel 10 closed. At this time, the two chemical bombs 100 are arranged in the above-mentioned longitudinal direction of the pressure vessel 10. These two chemical bombs 100 are not gathered into one place but placed in such a manner that a predetermined spacing g is provided between the chemical bombs 100 in the longitudinal direction.

In the next blasting step, the chemical bombs 100 are blasted by using a blasting device not shown in the Figure. These chemical bombs 100 are blasted not simultaneously, but sequentially at a predetermined time interval $\Delta t$. Specifically, there is performed a initial blasting step of blasting one of the chemical bombs 100 and a following blasting step of blasting the other chemical bomb 100 next to the blasted chemical bomb 100 after a particular time from the instant of the previous blast sequentially.

Both of the blasting steps are carried out by connecting the ignition device to the chemical bombs 100 respectively and igniting the two chemical bombs 100 sequentially at the time interval $\Delta t$ by using a high-precision timer circuit. Such blasts reduce a mechanical load on the pressure vessel 10 to improve durability of the pressure vessel 10.

The inventors conducted the following test in order to confirm the effectiveness of the present invention. Specifically, a mechanical load on a pressure vessel 10 was examined in case where one or more chemical bombs 100 are placed at one position close to the center of the pressure vessel 10 and blasted simultaneously and in case where two or more chemical bombs 100 are spaced in the longitudinal direction of the pressure vessel 10 and blasted sequentially at a time interval.

More specifically, strain of the pressure vessel 10 was determined as an indicator of the mechanical load on the pressure vessel 10 (A) in case where one to three chemical bombs 100 are placed at one position close to the center of a pressure vessel 10 and blasted simultaneously, (B) in case where two chemical bombs 100 are placed at a predetermined spacing in the longitudinal direction of the pressure vessel 10 and sequentially blasted at a predetermined time interval, and (C) in case where three chemical bombs 100 are placed at a predetermined spacing in the longitudinal direction of the pressure vessel 10 and sequentially blasted at a predetermined time interval, respectively. As the chemical bomb 100 was used red bombs in the test.

Figure 5:
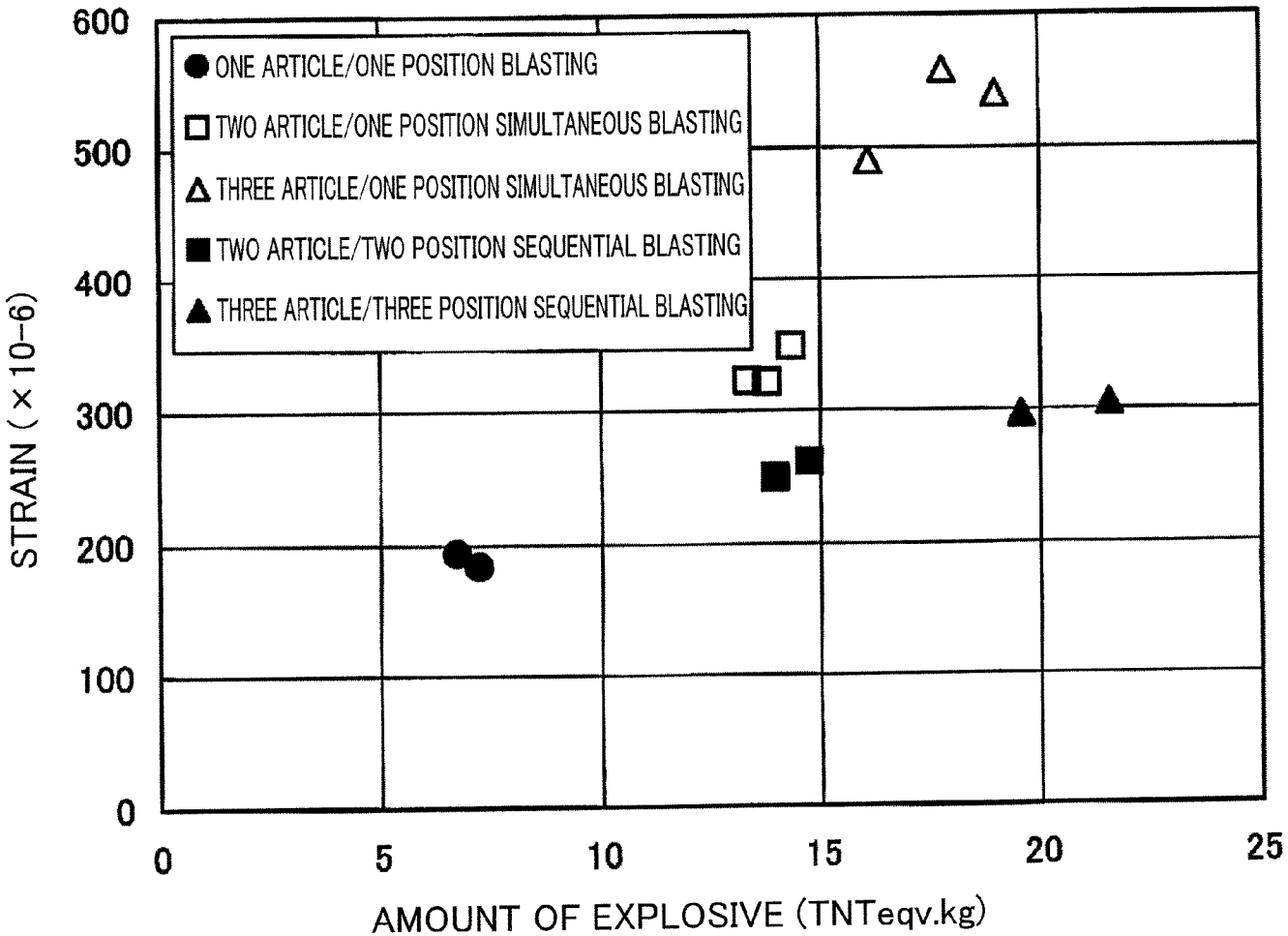
FIG. 5 is a graph showing an amount of strain of the pressure vessel obtained in the tests concerning the blasting methods according to the present invention and the comparative method.

The results of the test were summarized in FIG. 5. In FIG. 5, there are an abscissa being the sum of the amount of explosives contained in the chemical bomb 100 and the amount of a donor charge attached thereto, and an ordinate being the strain of the pressure vessel 10 when the chemical bombs 100 were detonated.

As shown in FIG. 5, the strain of the pressure vessel 10 in the case where two chemical bombs 100 were distributed at two positions and blasted sequentially at a certain time interval was smaller than that in the case where two chemical bombs 100 similar in the total explosive amount were concentrated at one position and blasted simultaneously. In addition, the strain of the pressure vessel 10 when three chemical bombs 100 were distributed at three positions and blasted sequentially at a certain time interval is also smaller than that in the case where three chemical bombs 100 were concentrated at one position and blasted simultaneously.

Further, either the strain of the pressure vessel 10 in the case where two chemical bombs 100 were distributed at two positions and sequentially blasted at a certain time interval, or the strain in the case where three chemical bombs 100 were distributed at three positions and sequentially blasted at a certain time interval, was not much different from that in the case where only one chemical bomb 100 is blasted.

These results indicate that distributing two or more articles to be treated at spaced positions and blasting them sequentially reduce a load on the pressure vessel 10 as compared with concentrating two or more articles to be treated at one position and blasting them simultaneously.

Similarly to blasting only one chemical bomb 100, blasting two or more chemical bombs 100 simultaneously in a pressure vessel 10 is also required to make a load on the pressure vessel 10 not extremely great. The intensity of the explosion shock wave on the wall is generally known to have a relationship almost proportional to the amount of explosive and inversely proportional to the third power of the distance between the explosive and the wall.

Figure 4:
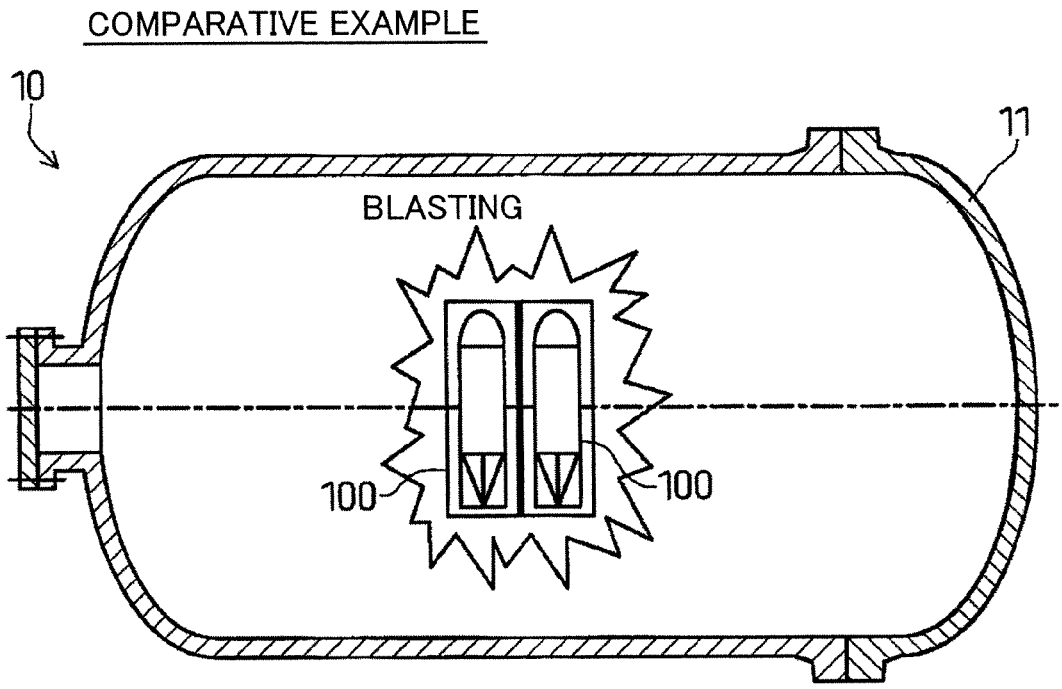
FIG. 4 is a cross-sectional view illustrating an comparative example of a location of two or more chemical bombs gathered into one place to be blasted simultaneously in one operation.

Accordingly, keeping the intensity of the explosion shock wave applied to the wall of pressure vessel 10 in a particular intensity range in the method of concentrating two or more chemical bombs 100 (articles to be treated) at one position as shown in FIG. 4 and blasting them simultaneously, requires to enlarge the size of the pressure vessel 10 in every direction according to increase in amount of the explosive to be treated. In a tube-shaped pressure vessel for example, it is required to enlarge not only its longitudinal size but also its diameter.

In contrast, the method of distributing two or more chemical bombs 100 in the longitudinal direction and blasting them sequentially at a certain time interval as the present embodiment shown in FIG. 3 requires no enlargement in diameter of the pressure vessel 10 and requires only slight enlargement in longitudinal size of the pressure vessel 10 corresponding to the spacing g between respective chemical bombs 100 to enable expanding capability. This method therefore enables improving the capability with little change of size of the pressure vessel 10 and thus of the blasting facility 1.

As described above, the blasting method in the present embodiment, which includes a step of installing two or more chemical bombs 100 at a predetermined spacing g in a pressure vessel 10, and a step of blasting one of the chemical bombs 100 and then blasting the next chemical bomb 100 after a particular time (time interval Δt) from the instant of the blast of the previous chemical bomb 100 sequentially, suppresses a load on the pressure vessel 10 to a level not much different from that when a single chemical bomb 100 is blasted (see FIG. 5). Thus, the method enables improving capability without increase in the load on the pressure vessel 10 and reduction of life of the pressure vessel 10.

In the method above, the time interval (Δt) may be determined according to the spacing g between the respective chemical bombs 100, in such a manner that the explosion shock wave caused by explosion of a previously blasted chemical bomb 100 reaches the next chemical bomb 100 after the next chemical bomb 100 is blasted, for example. Such a determination of the time interval Δt prevents the shock wave caused by blast of a particular chemical bomb 100 from reaching the next chemical bomb 100 before its explosion to damage a blasting device for the next chemical bomb 100 and thus interfere with perfect blast. In short, the determination ensures the perfect blast.

Furthermore, a method of using a pressure vessel 10 extending in a particular direction and installing chemical bombs 100 at a predetermined spacing g in the longitudinal direction of the pressure vessels 10, as shown in FIG. 3 for example, allows blasting two or more chemical bombs 100 in one operation only with extension of the pressure vessel 10 in its longitudinal direction. This makes it possible to improve capability with little change of the size of the pressure vessel 10.

In the present invention, the number of the articles to be treated in a single operation may be 4 or more. For blasting three or more articles to be treated in one operation, not constant may be spacings g between the respective articles or time intervals Δt between respective blasting timings.

The article to be treated in the present invention is not limited to the above-illustrated chemical bomb 100; the present invention may be applied to blast disposal of hazardous substance such as organic halogen for example. In such a case, two or more containers may be used to contain respective hazardous substances and be arranged at a particular spacing g in a longitudinal direction of a pressure vessel 10 to be blasted sequentially at a time interval Δt.

In addition, the present invention is not limited to the case where only one article to be treated is installed at on position, but includes case where two or more articles to be treated are installed at one position. For example, included is a case where two chemical bombs 100 are installed together in one place at one side in a longitudinal direction of a pressure vessel 10 as shown in FIG. 3 and the other two chemical bombs 100 together in another place at the opposite side apart from the first place at a particular spacing g.

Although the blasting disposal is carried out in the facility installed outdoor in the embodiment above, the present invention includes a method wherein a pressure vessel containing a tightly sealed explosive is buried in the ground to perform a blasting disposal therein.

The invention claimed is:

1. A blasting method of blasting articles to be treated in a pressure vessel, comprising:

an installing step of installing two or more articles to be treated, including a first article and a second article, at a predetermined spacing in the pressure vessel;

an initial blasting step of blasting the first article; and a following blasting step of blasting the second article next to the previously blasted first article after a particular time from the instant of the previous blast, wherein the initial blasting step and the following blasting step are carried out by connecting an ignition device to the first article and to the second article, and igniting the first article and the second article sequentially with a predetermined time interval between the ignition of the first article and the second article, and wherein each of the first and second articles is blasted sequentially through the initial blasting step and the following blasting step.

2. A blasting method of blasting articles to be treated in a pressure vessel, comprising:

an installing step of installing two or more articles to be treated at a predetermined spacing in the pressure vessel;

an initial blasting step of blasting one of the articles to be treated; and a following blasting step of blasting the other article to be treated next to the previously blasted article after a particular time from the instant of the previous blast, wherein each of the articles is blasted sequentially through the initial blasting step and the following blasting step, wherein the particular time is determined according to the spacing between the articles to be blasted, in such a manner that the explosion shock wave caused by explosion of the previously blasted article reaches the next article to be treated after the next article is blasted in the following blasting step.

3. The blasting method according to claim 1, wherein a vessel of a shape extending in a particular direction is used as the pressure vessel and wherein the first article and the second article are installed at a predetermined spacing in the longitudinal direction of the pressure vessel in the installing step.

4. A blasting method of blasting articles to be treated in a pressure vessel, comprising:

an installing step of installing two or more articles to be treated at a predetermined spacing in the pressure vessel;

an initial blasting step of blasting one of the articles to be treated; and a following blasting step of blasting the other article to be treated next to the previously blasted article after a particular time from the instant of the previous blast, wherein each of the articles is blasted sequentially through the initial blasting step and the following blasting step, wherein the particular time is determined according to the spacing between the articles to be blasted, in such a manner that the explosion shock wave caused by explosion of the previously blasted article reaches the next article to be treated after the next article is blasted in the following blasting step, wherein a vessel of a shape extending in a particular direction is used as the pressure vessel and wherein two or more articles to be treated are installed at a predetermined spacing in the longitudinal direction of the pressure vessel in the installing step.

* * * * *